US010619370B2

(12) United States Patent
Huang et al.

(10) Patent No.: US 10,619,370 B2
(45) Date of Patent: Apr. 14, 2020

(54) PIPELINE SYSTEM OF INFLATABLE SPA

(71) Applicant: BESTWAY INFLATABLES & MATERIAL CORP., Shanghai (CN)

(72) Inventors: Shuiyong Huang, Shanghai (CN); Jinnian Wang, Shanghai (CN); Jiang Xu, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 56 days.

(21) Appl. No.: 15/799,326

(22) Filed: Oct. 31, 2017

(65) Prior Publication Data

US 2019/0032351 A1 Jan. 31, 2019

(30) Foreign Application Priority Data

Jul. 28, 2017 (CN) ..... 2017 2 0930278 U

(51) Int. Cl.
*E04H 4/12* (2006.01)
*E04H 4/00* (2006.01)
*E04H 4/16* (2006.01)

(52) U.S. Cl.
CPC ..... *E04H 4/12* (2013.01); *E04H 4/0025* (2013.01); *E04H 4/169* (2013.01)

(58) Field of Classification Search
CPC ..... E04H 4/12; E04H 4/0025
USPC ..... 4/509
See application file for complete search history.

(56) References Cited

U.S. PATENT DOCUMENTS 6,256,805 B1 * 7/2001 Ludlow ..... A61H 33/027 4/541.1
7,908,684 B2 * 3/2011 Ludlow ..... A61H 33/02 4/584
2017/0058544 A1 * 3/2017 Lin ..... B05B 1/00

FOREIGN PATENT DOCUMENTS

CN 203583942 U 5/2014
CN 203628119 U 6/2014
CN 204953174 U 1/2016
CN 205206405 U 5/2016
CN 206233650 U 6/2017

* cited by examiner

*Primary Examiner* — Christine J Skubinna
(74) *Attorney, Agent, or Firm* — AJ Moss; Dickinson Wright PLLC

(57) ABSTRACT

A pipeline system of an inflatable SPA is provided. The pipeline system includes an air inlet pipeline; a water inlet pipeline, distributed along a circumferential direction of the inflatable SPA; and a plurality of jets for massage, where each of the plurality of jets includes a first water inlet, a first air inlet and an air-liquid mixing outlet, the first air inlet is connected with the air inlet pipeline, the first water inlet is connected with the water inlet pipeline, and air and water can be mixed in each of the plurality of jets and sprayed from the air-liquid mixing outlet. The water with bubbles can be sprayed into pool cavity surrounded by an inner pool wall of the inflatable SPA, which can play a massage effect on users.

12 Claims, 8 Drawing Sheets

PIPELINE SYSTEM OF INFLATABLE SPA

CROSS-REFERENCE TO RELATED APPLICATIONS

This application claims the benefit of priority to Chinese Patent Application No. 201720930278.8, titled "PIPELINE SYSTEM OF INFLATABLE SPA AND INFLATABLE SPA", filed on Jul. 28, 2017, the entire disclosure of which are incorporated herein by reference.

TECHNICAL FIELD

The present disclosure relates to a pipeline system of an inflatable SPA.

BACKGROUND

Nowadays, the inflatable SPA has an inner pool wall and an outer pool wall, the inner pool wall is enclosed to form a pool cavity, and the inner pool wall and the outer pool wall are enclosed to form an inflatable cavity. After the inflatable cavity is filled with air, a certain amount of water is infused into the pool cavity, and then the inflatable SPA can be used mainly for entertainment of children and adults in the inflatable SPA, which brings much fun to people's life.

However, after infusion of a certain amount of water into the existing inflatable SPA, the water in the inflatable SPA cannot be inflated with air, and thus a massage function cannot be achieved.

SUMMARY

A technical problem solved by the present disclosure is how to inflate water in an inflatable SPA with air.

In order to solve the above technical problem, a pipeline system of an inflatable SPA is provided in the present disclosure. The pipeline system may include: an air inlet pipeline; a water inlet pipeline, distributed along a circumferential direction of the inflatable SPA; and a plurality of jets for massage, wherein each of the plurality of jets includes a first water inlet, a first air inlet and an air-liquid mixing outlet, the first air inlet is connected with the air inlet pipeline, the first water inlet is connected with the water inlet pipeline, and air and water can be mixed in each of the plurality of jets and sprayed from the air-liquid mixing outlet.

Optionally, each of the plurality of jets includes: a water pipe body, wherein a water inlet channel is disposed in the water pipe body; and an air pipe body connected with an outer wall of the water pipe body, wherein an air inlet channel is disposed in the air pipe body, and an air outlet of the air inlet channel is communicated with the water inlet channel.

Optionally, the water pipe body includes: a first water pipe body portion; and a second water pipe body portion, wherein an inner diameter of the first water pipe body portion is smaller than an inner diameter of the second water pipe body portion, the air pipe body is fixed to an outer wall of the first water pipe body portion and is close to a junction of the first water pipe body portion and the second water pipe body portion.

Optionally, the air inlet pipeline includes at least one air inlet portion and a plurality of air inlet pipes, one end of each of the plurality of air inlet pipes is connected with the at least one air inlet portion and the other end of each of the plurality of air inlet pipes is connected with one of the plurality of jets.

Optionally, the air inlet pipeline includes a plurality of air inlet portions and a plurality of air inlet pipes; every two of the plurality of jets constitute a jet group, the jet group is distributed along a circumferential direction of the inflatable SPA and is fixed to an inner pool wall of the inflatable SPA; and the plurality of air inlet portions are fixed to an outer pool wall of the inflatable SPA, each of the plurality of air inlet portions is connected with each jet group via two of the plurality of air inlet pipes, and the two of the plurality of air inlet pipes are connected with the two of the plurality of jets included in the jet group.

Optionally, the air inlet pipeline includes an air inlet portion and a plurality of air inlet pipes, where the air inlet portion is connected with each of the plurality of jets via one of the plurality of air inlet pipes.

Optionally, the air inlet portion includes a main body portion including a first end portion and a second end portion, where the first end portion is provided with a plurality of air inlet ports, and the plurality of air inlet pipes are connected with the plurality of air inlet ports of the main body portion.

Optionally, the air inlet portion further includes: a pressing piece having a plurality of through holes, where each of the plurality of air inlet ports is tubular, and the plurality of air inlet pipes pass through the plurality of through holes and are sleeved outside the plurality of air inlet ports; and a fastening member, where the fastening member is fixedly connected with the first end portion of the main body portion, so that at least a portion of the pressing piece is positioned between the fastening member and the main body portion.

Optionally, an outer side of a tubular end portion of each of the plurality of air inlet ports is a conical surface, and a side wall of each of the plurality of through holes of the pressing piece is a conical surface matched with the outer side of the tubular end portion.

Optionally, a first pressure receiving surface is disposed on the pressing piece, a second pressure receiving surface is disposed on the fastening member, and the first pressure receiving surface and the second pressure receiving surface can be contacted with each other and pressed together.

Optionally, an internal thread is disposed on the fastening member, an external thread is disposed on the first end portion of the main body portion, the inner thread of the fastening member is matched and connected with the external thread of the first end portion of the main body portion; and a stopper portion is disposed on an outer side of the main body portion to prevent the fastening member from overpressing the pressing piece.

Optionally, the second end portion of the main body portion is provided with a first air inlet plug, and a plurality of air inlet channels are disposed in the air inlet plug.

Optionally, an opening is disposed on a side wall of each of the plurality of air inlet channels.

Optionally, an external thread is disposed on the air inlet plug, an internal thread is disposed on the second end portion of the main body portion, and the external thread of the air inlet plug is matched and connected with the internal thread of the second end portion of the main body portion.

Optionally, a connecting portion is disposed on the second end portion of the main body portion, and the connecting portion is connected with an outer wall of the inflatable SPA.

Optionally, the water inlet pipeline includes: a water inlet portion including a water inlet pipe, where a first water outlet port is disposed on the water inlet pipe; a multi-way pipe provided with a second water inlet and a plurality of second water outlets, where a connecting assembly is disposed between the multi-way pipe and the water inlet pipe, and the second water inlet of the multi-way pipe is connected with the first water outlet of the water inlet pipe via the connecting assembly; and a water connecting pipeline, connected with the plurality of second water outlets of the multi-way pipe.

Optionally, the connecting assembly includes: a first connecting portion extending from the first water outlet of the water inlet pipe; a second connecting portion extending from the second water inlet of the multi-way pipe, where the first connecting portion is sleeved outside the second connecting portion; and a fastening member disposed on an outer side of the first connecting portion and the second connecting portion and pressing the first connecting portion and the second connecting portion together.

Optionally, the connecting assembly further includes: a seal ring; and a seal ring groove disposed on an outer wall of the second connecting portion; where the sealing ring is disposed in the sealing ring groove when the first connecting portion is sleeved outside the second connecting portion, and the sealing ring is positioned between the first connecting portion and the second connecting portion.

Optionally, the fastening member is divided into two parts along an axial direction of the first connecting portion.

Optionally, the two parts of the fastening member are connected by a fastener; and the fastening member is threaded with the first connecting portion.

Optionally, the pipeline system further includes an exhaust system, where the exhaust system includes: an exhaust valve disposed on an outer wall of the inflatable SPA; an air pump configured to draw air from the inflatable SPA; and an exhaust connecting member mounted between the exhaust valve and the air pump.

Optionally, the exhaust connecting member includes: a first pipe body, where a pump connecting portion is disposed on an end portion of the first pipe body, the pump connecting portion is connected with the air pump; and a second pipe body, wherein a second air inlet is disposed on a side wall of the second pipe body, an exhaust valve connecting portion is disposed outside the second air inlet and connected with the exhaust valve, and the second air inlet is communicated with the exhaust valve; wherein an inner diameter of the first pipe body is greater than an inner diameter of the second pipe body, and the second air inlet is close to an intersection of the first pipe body and the second pipe body.

Optionally, a supporting member is disposed in the second pipe body and is positioned between the first pipe body and the second air inlet.

Compared with the prior art, the present disclosure has the following beneficial effects: a pipeline system of an inflatable SPA includes an air inlet pipeline, a water inlet pipeline and a plurality of jets for massage. The first air inlet of each of the plurality of jets is connected with the air inlet pipeline, the first water inlet of each of the plurality of jets is connected with the water inlet pipeline, and air and water can be mixed in each of the plurality of jets and sprayed from the air-liquid mixing outlet of each of the plurality of jets to the pool cavity surrounded by the inner pool wall of the inflatable SPA, so that the water with air bubbles can play a massage effect on users.

DETAILED DESCRIPTION

In order to make the above-mentioned objects, features and advantages of the present disclosure more easily understood, specific embodiments of the present disclosure will be described in detail with reference to the accompanying drawings.

Figure 1:
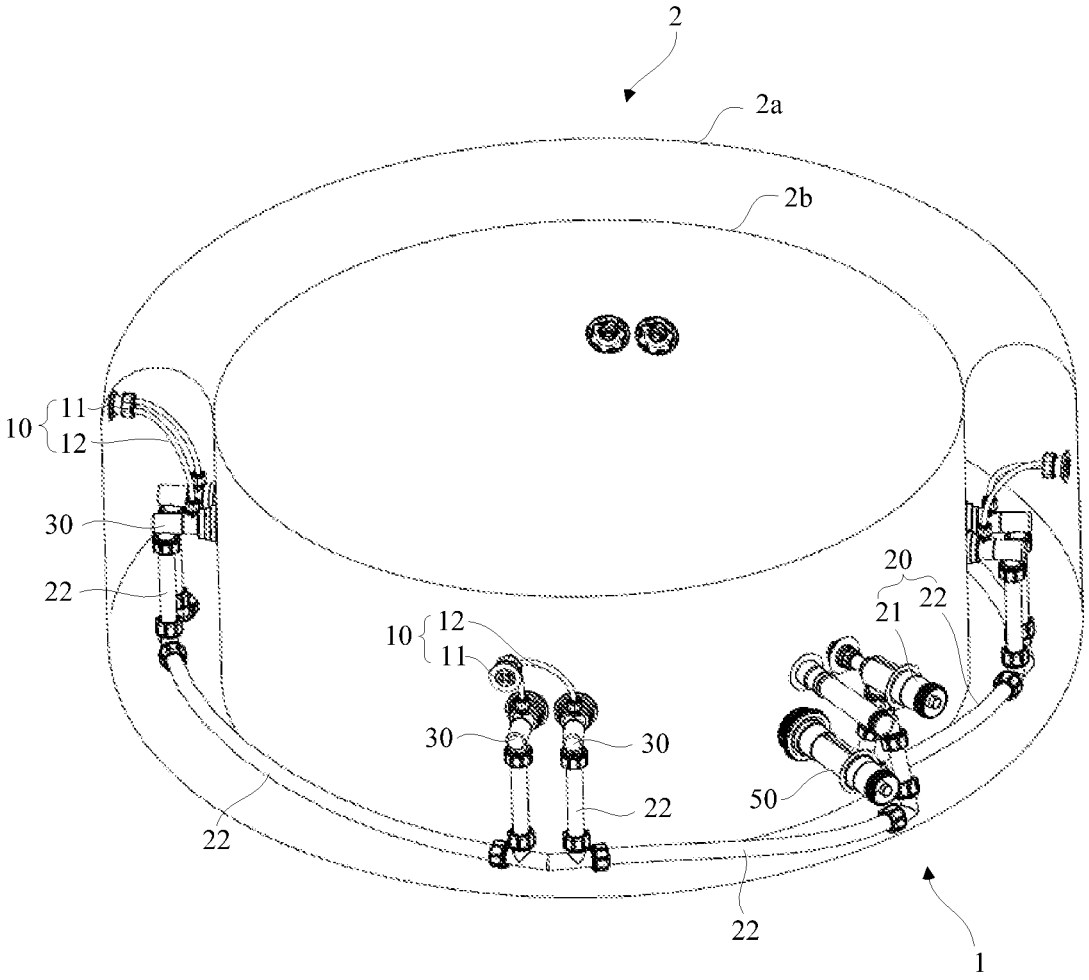
FIG. 1 schematically illustrates a cross-sectional view of an inflatable SPA according to an embodiment of the present disclosure, where a pipeline system of the inflatable SPA is shown.
Figure 2:
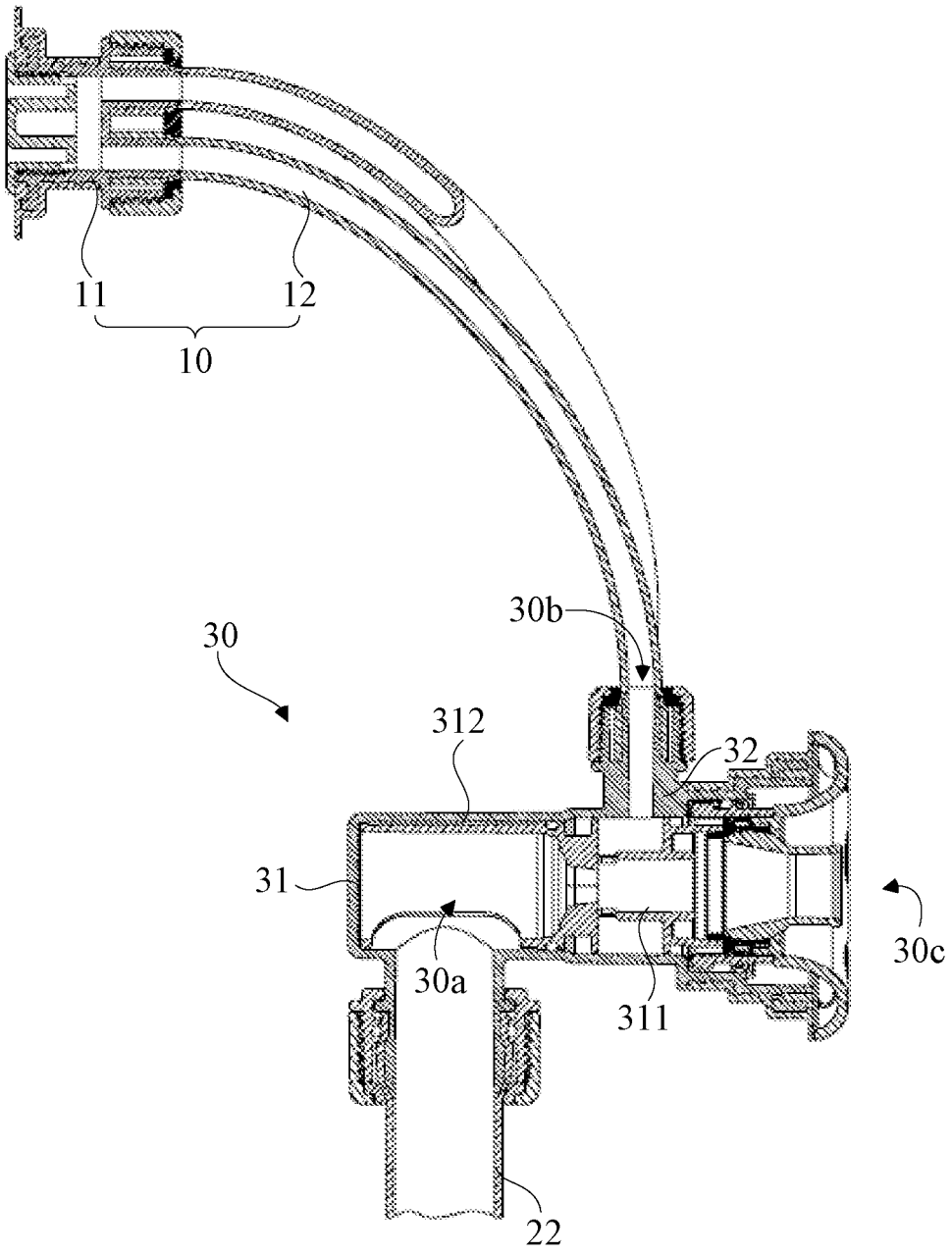
FIG. 2 schematically illustrates a cross-sectional view of a jet for massage of the pipeline system shown in FIG. 1, where an installation relationship between an air inlet pipeline and the jet is shown.

It will be appreciated that, an "inflatable SPA" in the present disclosure refers to an inflatable pool with a massage function. Referring to FIGS. 1 and 2, a pipeline system 1 applied to an inflatable SPA 2 is provided according to an embodiment of the present disclosure. The pipeline system 1 is mounted in an air cavity surrounded by an outer pool wall 2*a* and an inner pool wall 2*b* of the inflatable SPA 2, and includes an air inlet pipeline 10, a water inlet pipeline 20 and a plurality of jets 30 for massage. The water inlet pipe 20 is distributed along a circumferential direction of the inflatable SPA 2 and makes a circle around the inflatable SPA 2. Each of the plurality of jets 30 has a first water inlet 30*a*, a first air inlet 30*b* and an air-liquid mixing outlet 30*c*, the first air inlet 30*b* of each of the plurality of jets 30 is connected with the air inlet pipeline 10, and the first water inlet 30*a* of each of the plurality of jets 30 is connected with the water inlet pipeline 20. Air delivered from the air inlet pipeline 10 can pass through the first air inlet 30*b* and enter an interior of each of the plurality of jets 30, water delivered from the water inlet pipeline 20 can pass through the first water inlet 30*a* and enter the interior of each of the plurality of jets 30, and then the air and the water can be mixed in each of the plurality of jets 30 and sprayed from an air-liquid mixing outlet 30*c* of each of the plurality of jets 30 into a pool cavity surrounded by an inner pool wall 2*b* of the inflatable SPA 2, so that the water with air bubbles can play a massage effect on users.

In addition, the pipe system 1 may further include a water outlet pipeline 50, and the water outlet pipeline 50 may include a water outlet portion fixed to the inner pool wall 2*b* of the inflatable SPA 2. A pump pumps water from a pool cavity surrounded by the inner pool wall 2*b* of the inflatable SPA 2 via the water outlet pipeline 50 and pumps the water into the water inlet portion 21 and a water connecting pipeline 22, so that a water circulation of massage waterways among the water inlet pipeline 20, the inflatable SPA 2, the water outlet pipeline 50 and the pump can be formed.

With continued reference to FIG. 2, in some embodiments, the jet 30 may include a water pipe body 31 and an air pipe body 32, where a water inlet channel is disposed in the water pipe body 31, and water can enter the jet 30 from the first water inlet 30*a* of the water inlet channel. The air pipe body 32 is connected with an outer wall of the water pipe body 31, an air inlet channel is disposed in the air pipe body 32, air can enter the jet 30 from the first air inlet 30*b* of the air inlet channel, and an air outlet of the air inlet channel is communicated with the water inlet channel, so that air and water can be mixed in the jet 30 and form water with bubbles, and finally the water with bubbles can be sprayed from the air-liquid mixing outlet 30*c*.

In some embodiments, the water pipe body 31 may include a first water pipe body 311 and a second water pipe body 312. An inner diameter of the first water pipe body portion 311 is smaller than an inner diameter of the second water pipe body portion 312, and the air pipe body 32 is fixed to an outer wall of the first water pipe body portion 311 and is close to a junction of the first water pipe body portion 311 and the second water pipe body portion 312. When water flows from the second water pipe body portion 312 into the first water pipe body portion 311, the first water pipe body 311 can generate a certain negative pressure at the junction, and thus air in the air pipe body 32 can be brought into the first water pipe body portion 311 due to an effect of the negative pressure, so that air and water can be mixed and discharged.

Figure 3:
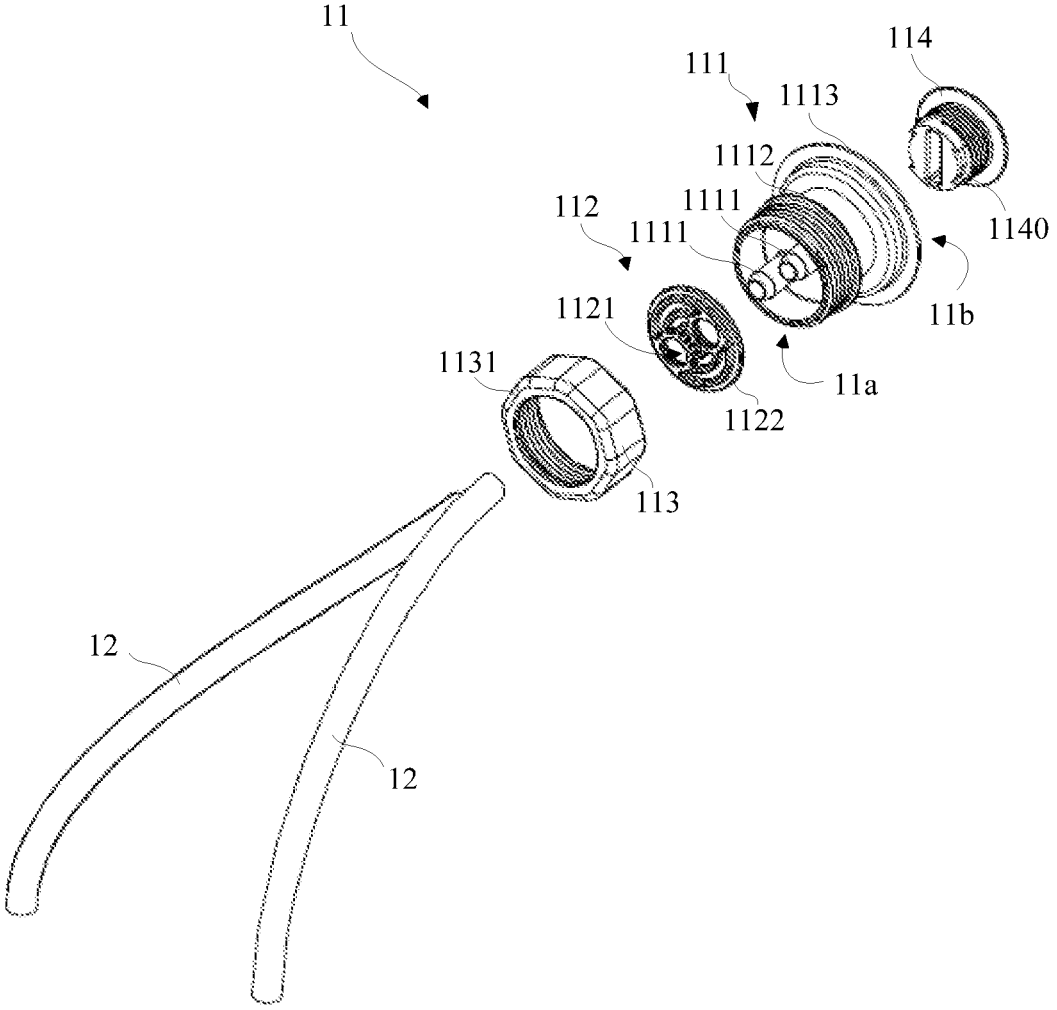
FIG. 3 schematically illustrates an exploded view of an air inlet portion of the air inlet pipeline shown in FIG. 1.
Figure 4:
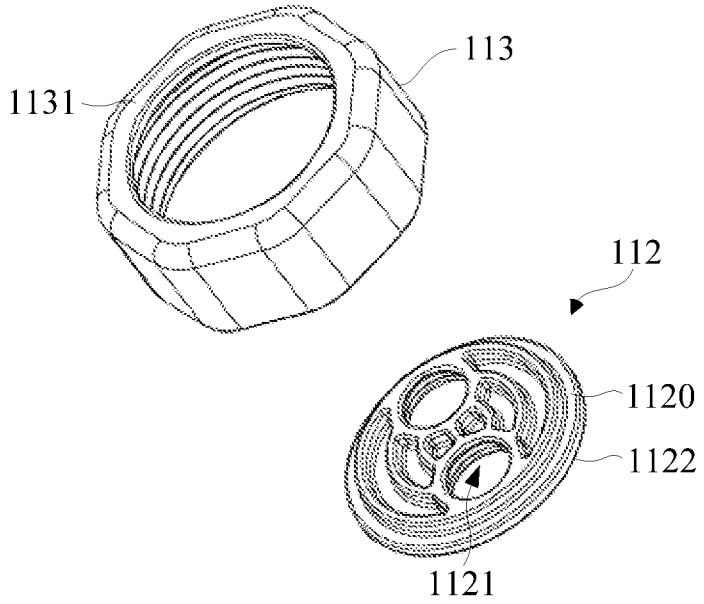
FIG. 4 schematically illustrates an exploded view of a pressing piece and a first fastening member of the air inlet portion shown in FIG. 1.
Figure 5:
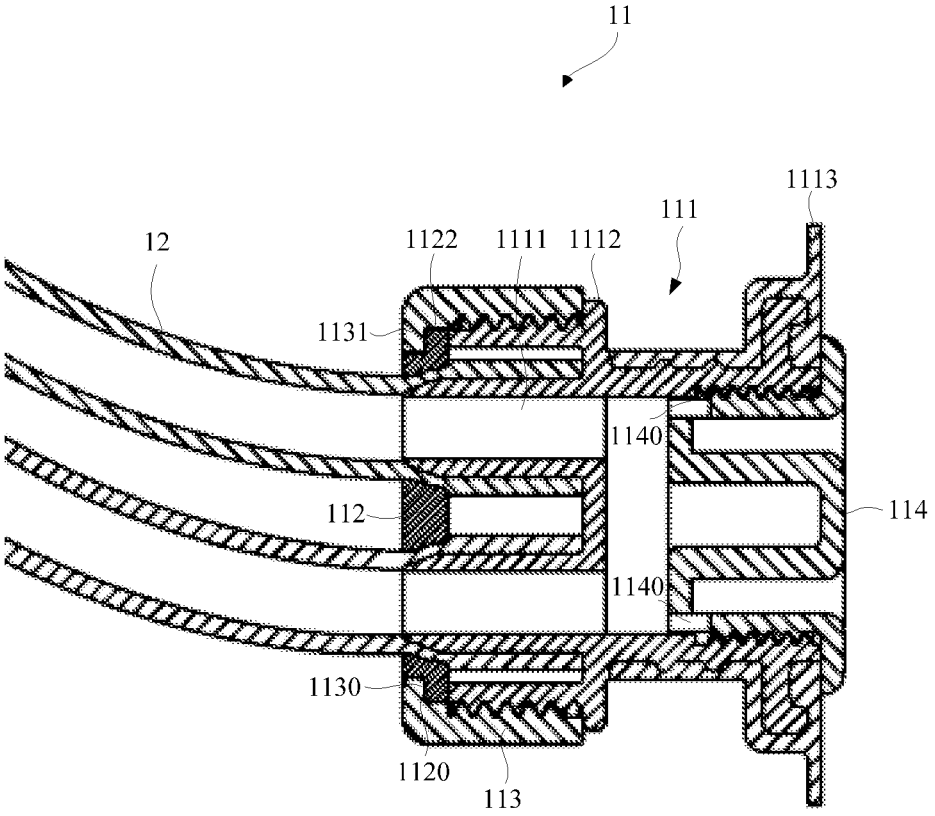
FIG. 5 schematically illustrates a cross-sectional view of the air inlet portion of the air inlet pipeline shown in FIG. 1, FIG. 6 schematically illustrates an exploded view of a multi-way pipe of a water inlet pipeline shown in FIG. 1.

Referring to FIGS. 3 to 5, in some embodiments, the air inlet pipeline 10 may include at least one air inlet portion 11 and a plurality of air inlet pipes 12, where one end of each of the plurality of air inlet pipes 12 is connected with the at least one air inlet portion 11, and the other end of each of the plurality of air inlet pipes 12 is connected with the jet 30. Air can enter from the at least one air inlet portion 11 of the air inlet pipeline 10 and enter an interior of the air pipe body 32 of the jet 30 via the air inlet pipe 12.

In conjunction with FIG. 1, in the some embodiments, every two of the plurality of jets 30 constitute a jet group, each jet group is distributed along a circumferential direction of the inflatable SPA 2, and a distance between adjacent jet groups is set to be the same. The two jets 30 in each jet group are fixed to the inner pool wall 2*b* of the inflatable SPA 2. Each air inlet portion 11 is fixed to an outer pool wall 2*a* of the inflatable SPA 2, each air inlet portion 11 is connected with each jet group through two air inlet pipes 12, and the two air inlet pipes 12 are respectively connected with the two jets 30 of the jet group. In other embodiments, one air inlet portion may correspond to a plurality of air inlet pipes, and each of the plurality of air inlet pipes may correspond to one jet.

With continued reference to FIGS. 3 to 5, in some embodiments, the air inlet portion 11 may include a main body portion 111, the main body portion 111 may include a first end portion 11*a* and a second end portion 11*b*, a plurality of air inlet ports 1111 are disposed on the first end portion 11*a* of the main body portion 111, and the plurality of air inlet pipes 12 are connected with the plurality of air inlet ports 1111 of the main body portion 111. As shown in FIG. 1, in some embodiments, two air inlet ports 1111 are disposed on the first end portion 11*a* of the main body portion 111, and each of the two air inlet ports 1111 is connected with one of two air inlet pipes 12, so that air can enter into the air inlet pipe 12 from the two air inlet ports 1111.

In some embodiments, the air inlet portion 11 may further include a pressing piece 112 and a first fastening member 113. A plurality of through holes 1121 are disposed on the pressing piece 112, each of the plurality of air inlet ports 1111 has a tubular structure, and each of the plurality of air inlet pipes 12 pass through the plurality of through holes 1121 on the pressing piece 112 and is sleeved outside each of the plurality of air inlet ports 1111. The first fastening member 113 is fixedly connected with the first end portion 11*a* of the main body portion 111, so that at least a portion of the pressing piece 112 is positioned between the first fastening member 113 and the main body portion 111.

Referring to FIGS. 4 and 5, a step 1122 is disposed along an outer periphery of the pressing piece 112, and a first pressure receiving surface 1120 is disposed on the step 1122; one end of the first fastening member 113 extends along an inner circumference of an inner wall of the first fastening member 113 to form an edge portion 1131, and a second pressure receiving surface 1130 is disposed on an inner portion of the edge portion 1131 towards the first fastening member 113. The first pressure receiving surface 1120 of the pressing piece 112 and the second pressure receiving surface 1130 of the first fastening member 113 can be contacted with each other and pressed together.

When the first fastening member 113 and the main body portion 111 are fixedly connected, the first fastening member 113 applies a certain pressure to the pressing piece 112, so that the pressing piece 112 can apply a certain pressure to the plurality of air inlet pipes 12. Since the air inlet pipe 12 is a hose, and the first fastening member 113 and the plurality of air inlet ports 1111 are rigid members, a certain of deformation may occur to the plurality of air inlet pipes 12 at a junction of the plurality of air inlet pipes 12 and the plurality of air inlet ports 1111, so that the plurality of air inlet pipes 12 can be tightly connected with the plurality of air inlet ports 1111 to achieve a sealing effect.

An outer side of a tubular end portion of each of the plurality of air inlet ports 1111 is a conical surface, and a side wall of each of the plurality of through holes 1121 of the pressing piece 112 is a conical surface matched with the outer side of tubular end portion. The tubular end portion with the conical outer side allows each of the plurality of air inlet pipes 12 to be sleeved outside each of the plurality of air inlet ports 1111 more easily during an installation process. Each of the plurality of through holes 1121 with the conical side wall is matched with the tubular end portion with the conical outer side, so that a pressure receiving area of each of the plurality of air inlet pipes 12 at a pressurized position can be increased and the received pressure can be uniform, which makes the sealing performance better and can avoid breakage of the plurality of air inlet pipes 12.

An internal thread is disposed on the first fastening member 113, an external thread is disposed on the first end portion 11 a of the main body portion 111. The first fastening member 113 is sleeved outside the first end portion 11*a* of the main body portion 111, so that the internal thread of the first fastening member 113 can be matched and connected with the external thread of the first end portion 11*a* of the main body portion 111, to make the first fastening member 113 and the main body portion 111 fixedly connected with each other. An outer side wall of the main body portion 111 along a circumferential direction extends outside to form a stopper portion 1112, where the stopper portion 1112 is in an annular shape and is adjacent to the external thread of the first end portion 11*a*, and the stopper portion 1112 fixes the first fastening member 113 to a position of an outer side of the main body portion 111 to prevent the first fastening member 113 from over-pressing the pressing piece 112 and making the air inlet pipe 12 rupture.

In some embodiments, the second end portion 11*b* of the main body portion 111 is provided with an air inlet plug 114, and a plurality of air inlet channels are disposed in the air inlet plug 114. By disposing the plurality of air channels in the air inlet plug 114, it is possible to prevent large debris from entering the main body portion 111. In some embodiments, the air inlet plug 114 is provided with two air inlet channels. An opening 1140 is disposed on a side wall of each of the two air inlet channels. Air can enter the air inlet channel, flow into the air inlet port 1111 via the opening 1140, come out of the air inlet port 1111 and enter the air inlet pipe 12. The air inlet plug 114 is provided with an external thread, the second end portion 11*b* of the main body portion 111 is provided with an internal thread, and the second end portion 11*b* of the main body portion 111 is sleeved outside the air inlet plug 114. The external thread of the air inlet plug 114 is matched and connected with the internal thread of the second end portion 11*b* of the main body portion 111, so as to realize a fixed connection of the air inlet plug 114 and the main body portion 111.

A connecting portion 1113 is disposed on the second end portion 11*b* of the main body portion 111, and the connecting portion 1113 is connected with an outer pool wall 2*a* of the inflatable SPA 2, so that the air inlet portion 11 can be fixed to the outer pool wall 2*a* of the inflatable SPA 2. In some embodiments, the connecting portion 1113 may have a flange structure, which is connected to the main body portion 111 by a secondary injection molding process, and is welded to the outer pool wall 2*a*.

Figure 6:
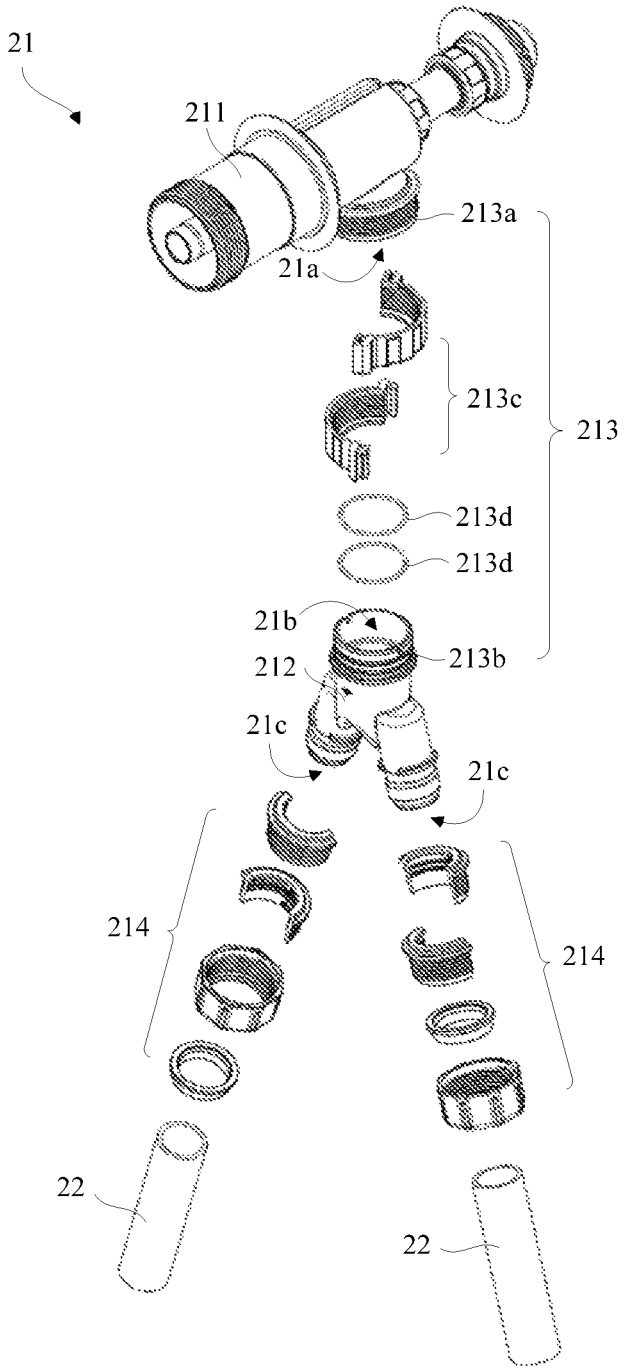
Figure 7:
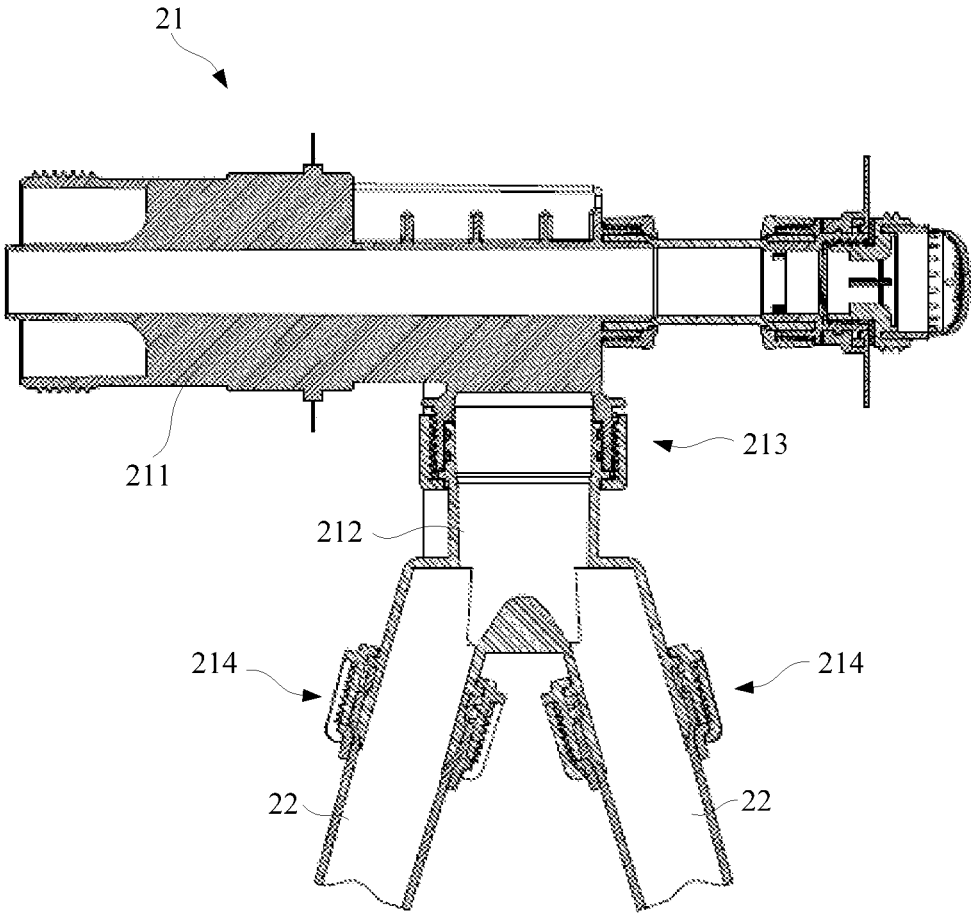
FIG. 7 schematically illustrates a cross-sectional view of the multi-way pipe of the water inlet pipeline shown in FIG. 1.

Referring to FIGS. 6 to 7 and in conjunction with FIG. 1, in some embodiments, the water inlet pipeline 20 may include a water inlet portion 21 and a water connecting pipeline 22. The water inlet portion 21 may include a water inlet pipe 211 and a multi-way pipe 212. The water inlet pipe 211 is provided with a first water outlet 21*a*, and the multi-way pipe 212 is provided with a second water inlet 21*b* and a plurality of second water outlets 21*c*. A connecting assembly 213 is disposed between the multi-way pipe 212 and the water inlet pipe 211, the second water inlet 21*b* of the multi-way pipe 212 is connected with the first water outlet 21*a* of the water inlet pipe 211 via the connecting assembly 213, and the second water outlet 21*c* of the multi-way pipe 212 is connected with the water connecting pipe 22 via the second connecting assembly 214. In some embodiments, the multi-way pipe 212 may include a second water inlet 21*b* and two second water outlets 21*c*, and two water connecting pipelines 22 are respectively connected with the two second water outlets 21*c*, so that water can flow out of the first water outlet 21*a* of the water inlet pipe 211 to the second water inlet 21*b* of the multi-way pipe 212, and flow out of the two second water outlets 21*c* of the multi-way pipe 212 into the two water connecting pipelines 22.

With continued reference to FIG. 6, in some embodiments, the connecting assembly 213 may include a first connecting portion 213*a* extending from the first water outlet 21*a* of the water inlet pipe 211, a second connecting portion 213*b* extending from the second water inlet 21*b* of the multi-way pipe 212, and a second fastening member 213*c*. The first connecting portion 213*a* is sleeved outside the second connecting portion 213*b*, and the second fastening member 213*c* is sleeved outside the first connecting portion 213*a* and the second connecting portion 213*b* and presses the first connecting portion 213*a* and the second connecting portion 213*b* together.

The second fastening member 213*c* may be divided into two parts along an axial direction of the first connecting portion 213*a*, and the two parts of the second fastening member 213*c* are fixedly connected via a fastener. During an installation process, after the first connecting portion 213*a* is sleeved to the second connecting portion 213*b*, the two parts of the second fastening member 213*c* form a ring shape via the fastener, and are sleeved to a lower position of the second connecting portion 213*b*. The second fastening member 213*c* is provided with an internal thread, the first connecting portion 213*a* is provided with an external thread, and the second fastening member 213*c* and the first connecting portion 213*a* are fixedly connected via the internal thread and the external thread, so that the first connecting portion 213*a* and the second connecting portion 213*b* can be tightly connected. In some embodiments, the second fastening member 213*c* can be divided into two completely separate semicircular rings along an axial direction of the first connecting portion 213*a*, and both ends of the two semicircular rings are respectively fixedly connected via a fastener. In other embodiments, one end of the two semicircular rings may be connected via a hinge structure and the other end of the two semicircular rings may be connected via a fastener.

In some embodiments, the connecting assembly 213 may further include a sealing ring 213*d*. A sealing ring groove is disposed on an outer wall of the second connecting portion 213*b*, and the sealing ring 213*d* is sleeved in the sealing ring groove on the outer wall of the second connecting portion 213*b* before the first connecting portion 213*a* is sleeved outside the second connecting portion 213*b*. The sealing ring 213*d* is positioned between the first connecting portion 213*a* and the second connecting portion 213*b*, so as to enhance a sealing performance of a junction between the first connecting portion 213*a* and the second connecting portion 213*b*, and to prevent water from flowing out of the junction.

In some embodiments, the inflatable SPA 2 may further include an exhaust system (not shown). When the inflatable SPA 2 is not in use, the exhaust system is applied to quickly discharge air in the air cavity surrounded by the outer pool wall 2*a* and the inner pool wall 2*b* of the inflatable SPA 2. The exhaust system may include an exhaust valve, an air pump and an exhaust connecting member 40, where the exhaust valve is disposed on an outside of the outer pool wall 2*a* of the inflatable SPA 2, the air pump is configured to draw air from the air cavity surrounded by the outer pool wall 2*a* and the inner pool wall 2*b* of the inflatable SPA 2, and the exhaust connecting member 40 is fixed between the exhaust valve and the air pump.

Figure 8:
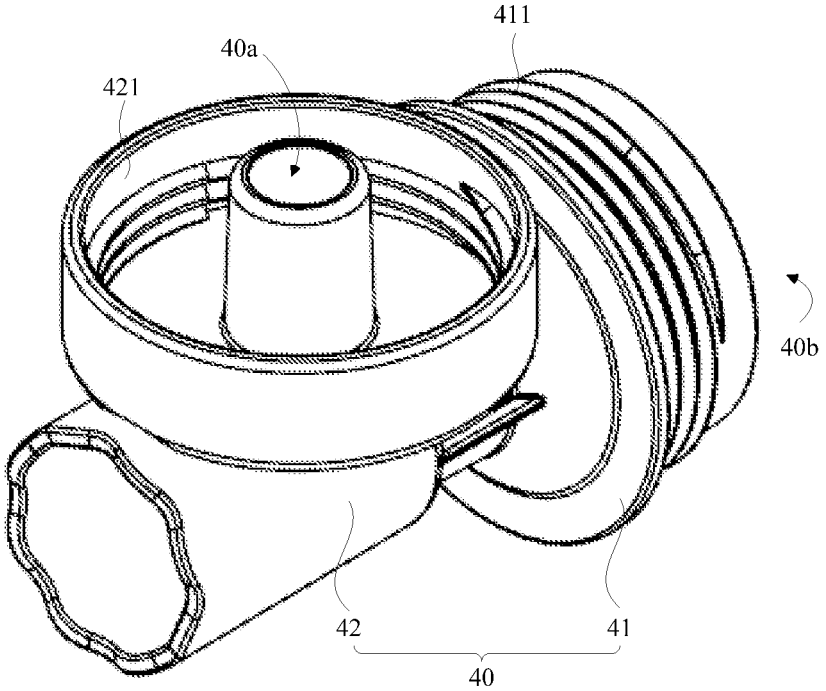
FIG. 8 schematically illustrates a stereogram of an exhaust connecting member according to an embodiment of the present disclosure.
Figure 9:
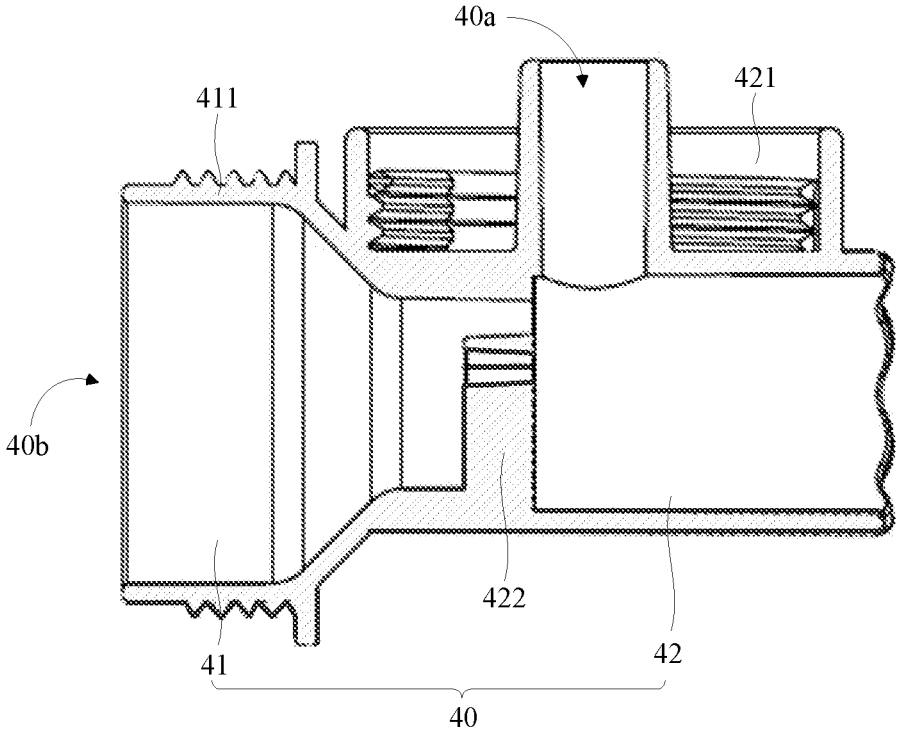
FIG. 9 schematically illustrates a cross-sectional view of the exhaust connecting member shown in FIG. 8.

Referring to FIGS. 8 and 9, in some embodiments, the exhaust connecting member 40 may include a first pipe body 41 and a second pipe body 42. A pump connecting portion and a third air inlet 40*b* are disposed on an end portion of the first pipe body 41, the pump connecting portion 411 may be a thread structure disposed outside the first pipe body 41, and the pump connecting portion 411 is connected with the air pump; and a second air inlet 40*a* is disposed on a side wall of the second pipe body 42, an exhaust valve connecting portion 421 provided with an internal thread is disposed outside the second air inlet 40*a* and connected with the exhaust valve disposed on the outer pool wall 2*a* of the inflatable SPA 2, and the second air inlet 40*a* is communicated with the exhaust valve. An inner diameter of the first pipe body 41 is greater than an inner diameter of the second pipe body 42, and the second air inlet 40*a* is closed to a junction of the first pipe body 41 and the second pipe body 42. When the air pump is operated, air around the air pump is driven into the third air inlet 40*b* and flows from the first pipe body 41 to the second pipe body 42. Since the inner diameter of the first pipe body 41 is greater than the inner diameter of the second pipe body 42, flow speed of air may increase when the air enters the second pipe body, so that the second pipe body 42 can produce a certain of negative pressure at the junction of the first pipe body 41 and the second pipe body 42, then the air in the second air inlet 40*a* can quickly enter the second pipe body 42 and be discharged.

A supporting member 422 is disposed in the second pipe body 42 and positioned between the first pipe body 41 and the second air inlet 40*a*, so that noise can be reduced when air passes through the supporting member 422 inside the exhaust connecting member 40.

Figure 10:
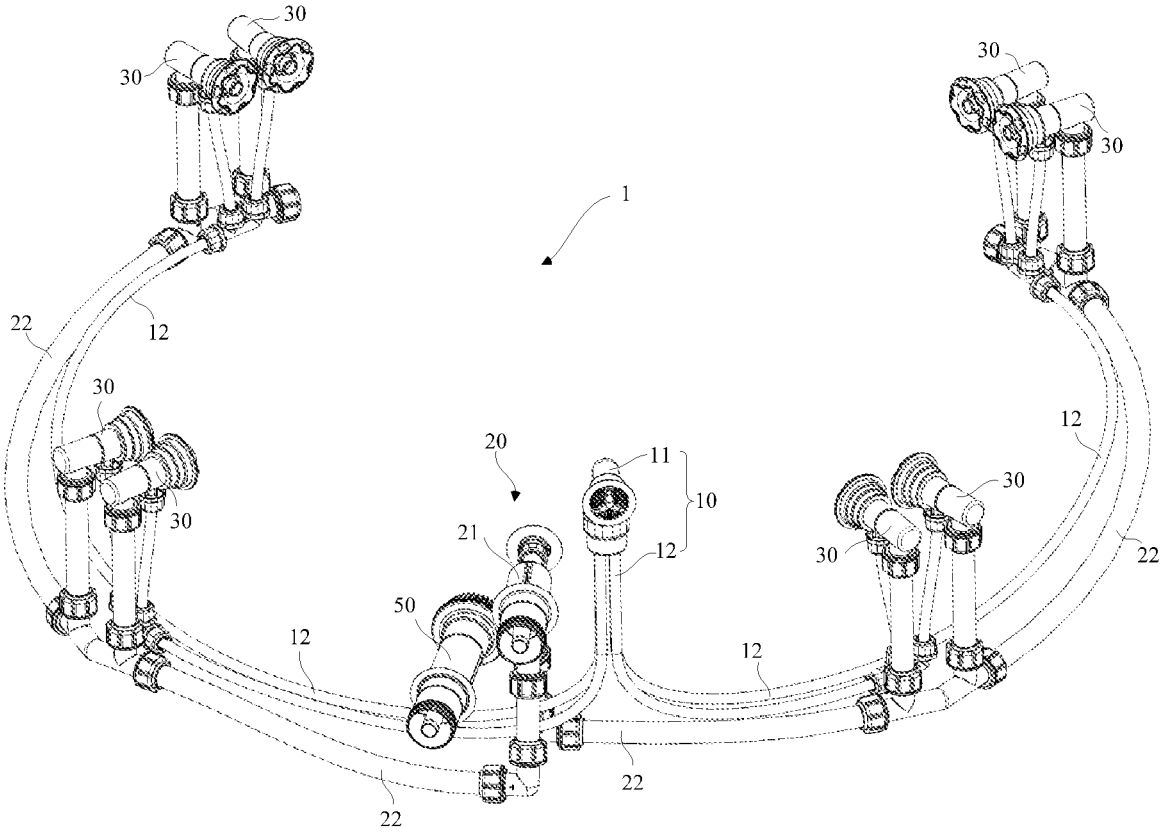
FIG. 10 schematically illustrates a diagram of a pipeline system of an inflatable SPA according to another embodiment of the present disclosure.

Referring to FIG. 10, FIG. 10 schematically illustrates a diagram of a pipeline system 1 of an inflatable SPA 2 with a massage function according to another embodiment of the present disclosure. The pipeline system 1 with a massage function is applied to an inflatable SPA 2 and is installed in an air chamber surrounded by an outer pool wall 2*a* and an inner pool wall 2*b* of an inflation pool 2, which includes an air inlet pipeline 10, a water inlet pipeline 20 and a plurality of jets 30 for massage.

In some embodiments, the air inlet pipeline 10 may include an air inlet portion 11 and a plurality of air inlet pipes 12, and the air inlet portion 11 is connected with each of the plurality of jets 30 via one of the plurality of air inlet pipes 12. Every two of the plurality of jets 30 constitute a jet group, the plurality of air inlet pipes 12 of each jet group are distributed along a circumferential direction of the inflatable SPA 2, and a distance between adjacent jet groups is set to be the same. The two jets 30 in each jet group are fixed to an inner pool wall 2*b* of the inflatable SPA 2. The air inlet portion 11 is fixed to an outer pool wall 2*a* of the inflatable SPA 2, and the air inlet portion 11 is connected with the jet groups through the plurality of air inlet pipes 12, where each jet group is connected with the air inlet portion 11 via one of the plurality of air inlet pipes 12 extending from the air inlet portion 11. The plurality of air inlet pipes 12 extend along a circumferential direction of the inflatable SPA 2 to an underneath of each jet group, and can be divided by a three-way pipe to form two air inlet pipes that are respectively connected with the two jets 30 of the jet group.

In the present invention, each embodiment uses a progressive writing method, which mainly focuses on the differences between the present embodiment and the foregoing embodiments, and the same portions in these embodiments can be referred to a foregoing embodiment.

Although the present disclosure is disclosed as above, the present disclosure is not limited thereto. Any person skilled in the art will be able to make various changes and modifications without departing from the spirit and scope of the present disclosure, and therefore the scope of the present disclosure should be limited by the scope of the claims.

What is claimed is:

1. A pipeline system of an inflatable SPA, comprising:

an air inlet pipeline;

a water inlet pipeline, distributed along a circumferential direction of the inflatable SPA; and a plurality of jets for massage, wherein each of the plurality of jets comprises a first water inlet, a first air inlet and an air-liquid mixing outlet, the first air inlet is connected with the air inlet pipeline, the first water inlet is connected with the water inlet pipeline, and air and water can be mixed in each of the plurality of jets and sprayed from the air-liquid mixing outlet;

wherein the air inlet pipeline comprises at least one air inlet portion and a plurality of air inlet pipes, one end of each of the plurality of air inlet pipes is connected with the at least one air inlet portion and the other end of each of the plurality of air inlet pipes is connected with one of the plurality of jets; and wherein the air inlet portion comprises:

a main body portion comprising a first end portion and a second end portion, wherein the first end portion is provided with a plurality of air inlet ports, and the plurality of air inlet pipes are connected with the plurality of air inlet ports of the main body portion;

a pressing piece having a plurality of through holes, wherein each of the plurality of air inlet ports is tubular, and the plurality of air inlet pipes pass through the plurality of through holes and are sleeved outside the plurality of air inlet ports; and a fastening member, wherein the fastening member is fixedly connected with the first end portion of the main body portion, so that at least a portion of the pressing piece is positioned between the fastening member and the main body portion.

2. The pipeline system according to claim 1, wherein each of the plurality of jets comprises:

a water pipe body, wherein a water inlet channel is disposed in the water pipe body; and an air pipe body connected with an outer wall of the water pipe body, wherein an air inlet channel is disposed in the air pipe body, and an air outlet of the air inlet channel is communicated with the water inlet channel.

3. The pipeline system according to claim 2, wherein the water pipe body comprises:

a first water pipe body portion; and a second water pipe body portion, wherein an inner diameter of the first water pipe body portion is smaller than an inner diameter of the second water pipe body portion, the air pipe body is fixed to an outer wall of the first water pipe body portion and is close to a junction of the first water pipe body portion and the second water pipe body portion.

4. The pipeline system according to claim 1, wherein the air inlet pipeline comprises a plurality of air inlet portions and a plurality of air inlet pipes; every two of the plurality of jets constitute a jet group, the jet group is distributed along a circumferential direction of the inflatable SPA and is fixed to an inner pool wall of the inflatable SPA; and the plurality of air inlet portions are fixed to an outer pool wall of the inflatable SPA, each of the plurality of air inlet portions is connected with each jet group via two of the plurality of air inlet pipes, and the two of the plurality of air inlet pipes are connected with the two of the plurality of jets comprised in the jet group.

5. The pipeline system according to claim 1, wherein the air inlet pipeline comprises:

an air inlet portion and a plurality of air inlet pipes, wherein the air inlet portion is connected with each of the plurality of jets via one of the plurality of air inlet pipes.

6. The pipeline system according to claim 1, wherein an internal thread is disposed on the fastening member, an external thread is disposed on the first end portion of the main body portion, the inner thread of the fastening member is matched and connected with the external thread of the first end portion of the main body portion; and a stopper portion is disposed on an outer side of the main body portion to prevent the fastening member from over-pressing the pressing piece.

7. The pipeline system according to claim 1, wherein the second end portion of the main body portion is provided with a first air inlet plug, and a plurality of air inlet channels are disposed in the air inlet plug.

8. The pipeline system according to claim 7, wherein an opening is disposed on a side wall of each of the plurality of air inlet channels.

9. The pipeline system according to claim 7, wherein a connecting portion is disposed on the second end portion of the main body portion, and the connecting portion is connected with an outer wall of the inflatable SPA.

10. A pipeline system of an inflatable SPA, comprising:

an air inlet pipeline;

a water inlet pipeline, distributed along a circumferential direction of the inflatable SPA; and a plurality of jets for massage, wherein each of the plurality of jets comprises a first water inlet, a first air inlet and an air-liquid mixing outlet, the first air inlet is connected with the air inlet pipeline, the first water inlet is connected with the water inlet pipeline, and air and water can be mixed in each of the plurality of jets and sprayed from the air-liquid mixing outlet;

wherein the air inlet pipeline comprises at least one air inlet portion and a plurality of air inlet pipes, one end of each of the plurality of air inlet pipes is connected with the at least one air inlet portion and the other end of each of the plurality of air inlet pipes is connected with one of the plurality of jets;

wherein the air inlet portion comprises:

a main body portion comprising a first end portion and a second end portion, wherein the first end portion is provided with a plurality of air inlet ports, and the plurality of air inlet pipes are connected with the plurality of air inlet ports of the main body portion; and wherein the second end portion of the main body portion is provided with a first air inlet plug, and a plurality of air inlet channels are disposed in the air inlet plug.

11. The pipeline system according to claim 10, wherein an opening is disposed on a side wall of each of the plurality of air inlet channels.

12. The pipeline system according to claim 10, wherein a connecting portion is disposed on the second end portion of the main body portion, and the connecting portion is connected with an outer wall of the inflatable SPA.

* * * * *